US010384698B2

(12) United States Patent
Da Costa et al.

(10) Patent No.: US 10,384,698 B2
(45) Date of Patent: Aug. 20, 2019

(54) RAIL CROSSOVER CONTROL SYSTEM

(71) Applicant: Technological Resources Pty. Limited, Melbourne, VIC (AU)

(72) Inventors: Ilidio Gouveia Da Costa, Kardinya (AU); Anthony Michael Godber, Karratha (AU); James Peter Kanakis, Cottesloe (AU); Arvind Maharaj, Victoria Park (AU); Tiberio Virgilio Nogueira Pereira, Kardinya (AU)

(73) Assignee: Technological Resources Pty. Limited, Melbourne, Victoria (AU)

( * ) Notice: Subject to any disclaimer, the term of this patent is extended or adjusted under 35 U.S.C. 154(b) by 244 days.

(21) Appl. No.: 15/319,226

(22) PCT Filed: Jun. 16, 2015

(86) PCT No.: PCT/AU2015/000356
§ 371 (c)(1),
(2) Date: Dec. 15, 2016

(87) PCT Pub. No.: WO2015/192169
PCT Pub. Date: Dec. 23, 2015

(65) Prior Publication Data

US 2017/0120938 A1 May 4, 2017

(30) Foreign Application Priority Data

Jun. 16, 2014 (AU) ..... 2014902300

(51) Int. Cl.
*B61L 19/06* (2006.01)
*B61L 1/16* (2006.01)
*B61L 23/30* (2006.01)

(52) U.S. Cl.
CPC ..... *B61L 19/06* (2013.01); *B61L 1/165* (2013.01); *B61L 23/30* (2013.01)

(58) Field of Classification Search
CPC ..... B61L 19/00; B61L 19/02; B61L 19/06; B61L 19/08; B61L 19/10; B61L 19/12; B61L 19/14; B61L 19/16
See application file for complete search history.

(56) References Cited

U.S. PATENT DOCUMENTS 2,454,249 A 11/1948 Broadbent
6,371,417 B1 * 4/2002 Southon ..... B61L 1/165 246/247

(Continued)

FOREIGN PATENT DOCUMENTS

EP 2090491 A1 8/2009

OTHER PUBLICATIONS

Jul. 30, 2014 Australian International-Type Search Report and Written Opinion in Australian Application 2014902300.

(Continued)

*Primary Examiner* — Robert J McCarry, Jr.
(74) *Attorney, Agent, or Firm* — Banner & Witcoff, Ltd.

(57) ABSTRACT

A rail crossover control system for a rail track section is disclosed. The rail track section has first and second rail tracks, a crossover track section extending between the first and second rail tracks, at least one first set of rail switches arranged to controllably determine whether a train continues on the first track or is diverted from the first track onto the crossover track section, and at least one second set of rail switches arranged to controllably determine whether a train continues on the second track or is diverted from the second track onto the crossover track section. The system comprises at least one interlocking control unit arranged to control the first and second sets of rail switches according to determined train routes, and an obstruction detector arranged to detect (Continued)

presence of an obstruction on the crossover track section and generate an obstruction signal when an obstruction is detected.

20 Claims, 5 Drawing Sheets

(56) References Cited

U.S. PATENT DOCUMENTS

| | | | | |
|---|---|---|---|---|
| 8,214,092 | B2 * | 7/2012 | Ghaly | B61L 19/06 701/19 |
| 2007/0014532 | A1 | 1/2007 | Parisi et al. | |
| 2009/0143928 | A1 | 6/2009 | Ghaly | |

OTHER PUBLICATIONS

Sep. 11, 2015—International Search Report and Written Opinion of PCT/AU2015/000356.

* cited by examiner

RAIL CROSSOVER CONTROL SYSTEM

CROSS-REFERENCE TO RELATED APPLICATIONS

The present application is a U.S. National Phase filing of International Application No. PCT/AU2015/000356, filed on Jun. 16, 2015, designating the United States of America and claiming priority to Australian Patent Application No. 2014902300 filed Jun. 16, 2014. The present application claims priority to and the benefit of all the above-identified applications, which are all incorporated by reference herein in their entireties.

FIELD OF THE INVENTION

The present invention relates to a rail crossover control system for controlling movement of trains through crossover sections of a rail network.

BACKGROUND OF THE INVENTION

It is known to provide complex rail networks with crossover track sections that facilitate passage of a train from a first track to a second adjacent track, and to control whether a train will transfer between the tracks or not by controlling a series of rail switches.

Typically, each crossover track section has a first set of 2 rail switches associated with respective rails of a first track, and a second set of 2 rail switches associated with respective rails of a second adjacent track. Each set of rail switches is movable between a normal position wherein a train passing over the rail switches will continue on the same track, and a reverse position wherein a train passing over the rail switches will transfer between the current track and a crossover track section. During operation, both sets of rail switches move together between the normal and reverse positions such that all sets of rail switches are either in the normal position or the reverse position. In order for a train to transfer between adjacent tracks, both sets of rail switches must be in the reverse position.

In a known system, the positions of the rail switches on a rail network are controlled centrally using a train control system that manages train routes and controls the positions of the rail switches accordingly.

For safety reasons, trains are only allowed to pass through a track section having a crossover section if both sets of rail switches are working correctly and determined to be in the same position. As a consequence, in order to ensure safety, if a failure occurs such that a set of rail switches at one side of the crossover track section cannot be detected by the train control system, controlled passage of trains through the tracks on both sides of the crossover is prevented, even though a set of rail switches on one side of the crossover track section is still operational.

In this circumstance, a train can only be allowed to pass through the operational side of the crossover if the operational rail switches are manually moved to the normal position and a paper based manually issued movement authority is provided to the train driver. The movement authority confirms that a relevant section of the rail network has been isolated for use by the train.

However, while ensuring safety, such a movement authority causes significant disruption to train throughput.

SUMMARY OF THE INVENTION

In accordance with a first aspect of the present invention, there is provided a rail crossover control system for a rail track section of a rail network, the rail track section having first and second rail tracks, a crossover track section extending between the first and second rail tracks, at least one first set of rail switches arranged to controllably determine whether a train continues on the first track or is diverted from the first track onto the crossover track section, and at least one second set of rail switches arranged to controllably determine whether a train continues on the second track or is diverted from the second track onto the crossover track section, the system comprising:

at least one interlocking control unit in cooperation with a train control system so as to control the first and second sets of rail switches according to determined train routes managed by the train control system;

a maintenance control unit (MCU) disposed adjacent the rail track section and arranged to facilitate local control and monitoring of at least one set of rail switches when control of the at least one set of rail switches has been handed over from the train control system to the MCU; and an obstruction detector comprising at least two wheel sensors arranged to sense presence of a wheel on the crossover track section and generate an obstruction signal when each of the following is satisfied:

the at least two wheel sensors sense the presence of a wheel;

the at least one first set of rail switches is under the control of the MCU and inoperative; and the at least one second set of rail switches is operative;

the interlocking control unit arranged to prevent trains from traveling over the at least one second set of operative rail switches when the obstruction signal is generated.

In an embodiment, at least one wheel sensor may be disposed adjacent a first end of the crossover track section, and at least one wheel sensor may be disposed adjacent a second opposite end of the crossover track section.

In an embodiment, the obstruction detector includes an axle counter, the axle counter including at least two wheel sensors.

In an embodiment, the rail crossover control system comprises a train control system arranged to manage train routes over the rail network.

The rail crossover control system may be arranged to manage handover of control of the at least one set of rail switches of the rail track section between the train control system and the MCU.

In an embodiment, the handover of control of the at least one set of rail switches of the rail track section between the train control system and the MCU is at least partly managed by the MCU.

The MCU may be arranged to facilitate sending of a request communication from the MCU to the train control system, the request communication indicative that an operator at the MCU wishes to transfer control of the at least one set of rail switches to the MCU.

In an embodiment, the train control system is arranged to receive the request communication and in response to communicate the location of the at least one set of rail switches associated with the request to a train controller.

In an embodiment, the train control system includes a display device arranged to display a representation of the track section to a train controller, and the location of the at least one set of rail switches associated with the request is communicated to the train controller by displaying a rail switch position identifier at a corresponding location on the representation.

The train control system may be arranged to facilitate sending of an acknowledgement communication from the train control system to the MCU, the acknowledgement communication indicative that a train controller approves the request to transfer control of the at least one set of rail switches to the MCU.

In an embodiment, the MCU includes a maintenance switch disposable in an OFF position wherein control of the at least one set of rail switches is with the train control system, or a MAINTENANCE position wherein control of the at least one set of rail switches is transferred to the MCU, and the MCU is arranged to prevent the maintenance switch from moving to the MAINTENANCE position until the acknowledgement communication is received at the MCU.

In an embodiment, the train control system is arranged to facilitate selection of a section of rail track or crossover track section, and to add an electronic block to the selected section of rail track or crossover track section, the electronic block serving to prevent the train control system from setting train routes that pass through the selected section of rail track or crossover track section.

The train control system may be arranged to send the acknowledgement communication only if at least one local control criterion is satisfied. The at least one local control criterion may comprise any one or more of:

i) all train routes are normal for both ends of the crossover track section;

ii) the crossover track section is unoccupied;

iii) the set of rail switches at the crossover end opposite to the crossover end under request are operational or under control of the MCU;

iv) the rail track associated with the crossover end under request has an electronic block placed on it at the train control system; and v) the maintenance switch is in the OFF position.

In an embodiment, the MCU comprises at least one visual indicator arranged to communicate to an operator the status of handover of control of the at least one set of rail switches to the MCU, whether the crossover track section or rail tracks associated with the rail track section are occupied or clear, and/or whether the at least one set of rail switches are operating correctly when controlled by the MCU.

In an embodiment, the rail crossover control system is arranged to generate an audible and/or visible alarm at the rail track section when an obstruction is detected on the crossover track section.

In an embodiment, the rail crossover control system comprises a crossover interface unit arranged to interface with the MCU, the crossover interface unit arranged to instigate sending of the obstruction signal to the train control system when an obstruction is detected on the crossover track section.

In an embodiment, the rail crossover control system comprises an MCU associated with each end of the crossover track section, each MCU arranged to facilitate local control and monitoring of at least one set of rail switches associated with an end of the crossover track section.

In an embodiment, the interlocking control unit is arranged to prevent trains from traveling over the at least one second set of operative rail switches in response to receipt of the obstruction signal until a clear communication is received at the interlocking control unit indicative that the crossover track section is now clear.

Each crossover end may have an associated regular mode wherein monitoring and control of the set of rail switches associated with the crossover end is with the train control system, and degraded mode wherein monitoring and control of the set of rail switches associated with the crossover end is not with the train control system. Degraded mode may include a failed sub-mode wherein a failure has occurred in relation to a set of rail switches associated with the crossover end, and local control mode wherein the set of rail switches is monitored and controlled locally at the rail track section.

In accordance with a second aspect of the present invention, there is provided a method of controlling a rail crossover of a rail track section of a rail network, the rail track section having first and second rail tracks, a crossover track section extending between the first and second rail tracks, at least one first set of rail switches arranged to controllably determine whether a train continues on the first track or is diverted from the first track onto the crossover track section, and at least one second set of rail switches arranged to controllably determine whether a train continues on the second track or is diverted from the second track onto the crossover track section, the method comprising:

using at least one interlocking control unit in cooperation with a train control system to detect and control the first and second sets of rail switches according to determined train routes managed by the train control system when the first and second sets of rail switches are operative;

disposing a maintenance control unit (MCU) adjacent the rail track section, the MCU arranged to facilitate local control and monitoring of at least one set of rail switches when control of the at least one set of rail switches has been handed over from the train control system to the MCU;

sensing presence of a wheel on the crossover track section using at least two wheel sensors when each of the following is satisfied:

the at least one first set of rail switches is inoperative and under the control of the MCU; and the at least one second set of rail switches is operative; and preventing trains from traveling over the at least one second set of operative rail switches when the obstruction signal is generated.

BRIEF DESCRIPTION OF THE DRAWINGS

The present invention will now be described, by way of example only, with reference to the accompanying drawings, in which.

DESCRIPTION OF AN EMBODIMENT OF THE INVENTION

In the following described embodiments, a rail crossover control system is described in relation to a rail network of a mine operation that is arranged to transport a bulk commodity from multiple mine sites to one or more port facilities. The rail network may include single track sections, wherein trains travel in opposite directions on the same track and pass each other at sidings distributed along the track, and double track sections, wherein trains travel in opposite directions on respective adjacently disposed tracks.

For maintenance purposes, the double track sections include crossover track sections that extend between respective tracks of the double track. The crossover sections facilitate passage of a train temporarily to an adjacent track ordinarily used for a train travelling in the opposite direction, so that the train can travel across the rail network and at the same time maintenance can be carried out on a section of the track.

In the present example, control and monitoring of the trains on the network is carried out at a train control system in networked communication with the rail network. The train control system is arranged to enable train controller personnel to efficiently manage train routes in consideration of track sections that are undergoing maintenance, whilst ensuring that train collisions are avoided.

The train control system incorporates operator monitoring stations from which train controllers may monitor and control movement of trains on the rail network.

Figure 1:
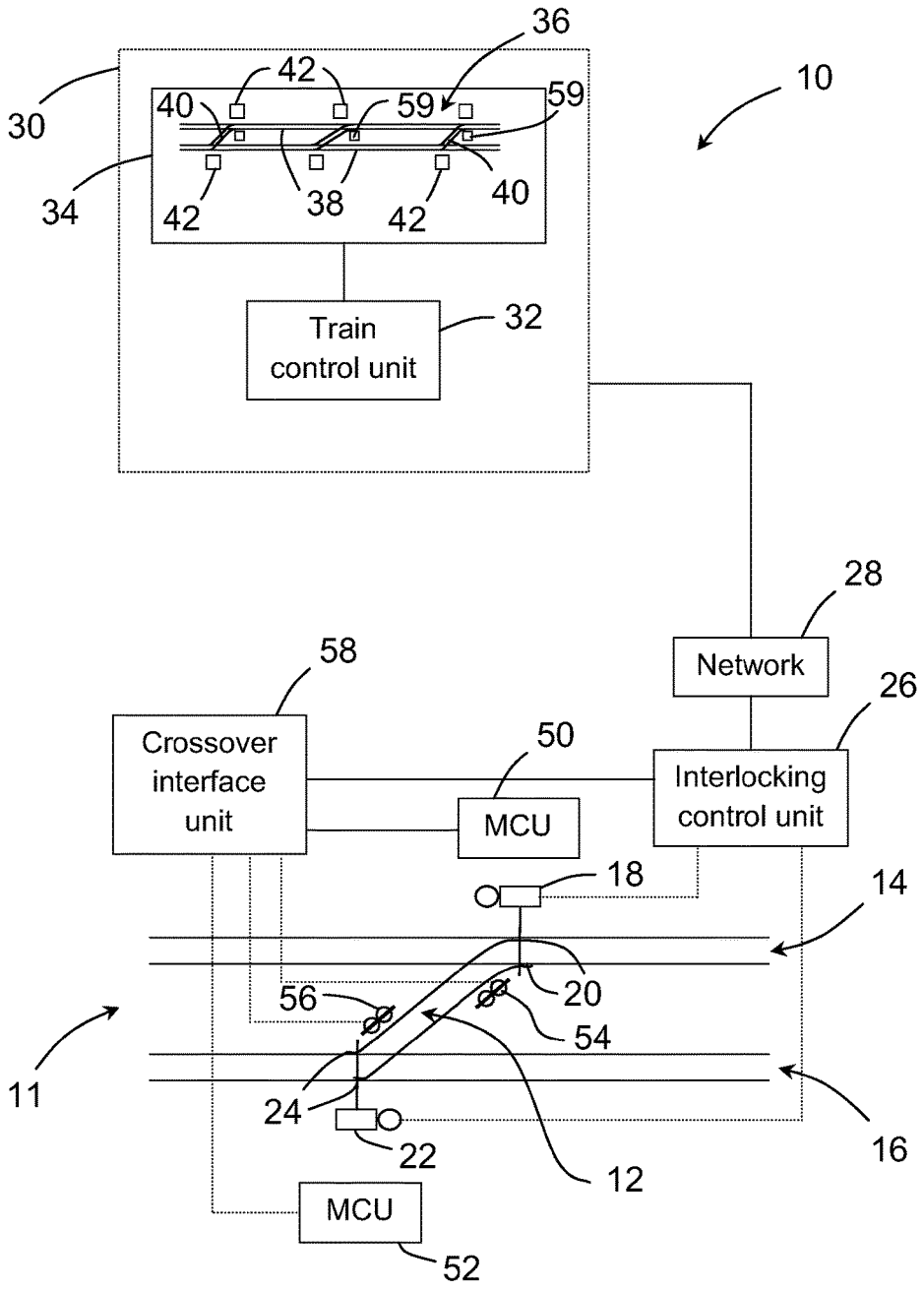
FIG. 1 is a schematic block diagram illustrating a rail crossover control system according to an embodiment of the present invention.

Referring to FIG. 1, there is shown an example crossover control system 10 for controlling operation of crossover track sections 12 of a rail network, in particular for controlling operation of rail switches on the rail network and thereby routing of trains on the rail network.

FIG. 1 illustrates one track section 11 of the rail network that has a crossover track section 12, although it will be understood that multiple similar track sections 11 having associated crossover track sections would typically be present on the rail network.

In this example, the track section 11 includes a first rail track 14 used to transport trains in a first direction, and a second rail track 16 used to transport trains in the opposite direction.

Associated with the first rail track 14 is a first point control machine 18 arranged to effect controlled movement of a first set of rail switches 20. The first set of rail switches 20 are disposable in a normal position, wherein a train traveling over the rail switches 20 will continue to travel along the first rail track 14, and a reverse position, wherein a train traveling over the rail switches 20 will divert from the first rail track 14 and travel along the crossover track section 12.

Similarly, associated with the second rail track 16 is a second point control machine 22 arranged to effect controlled movement of a second set of rail switches 24. The second set of rail switches 24 are disposable in a normal position, wherein a train traveling over the rail switches 24 will continue to travel along the second rail track 16, and a reverse position, wherein a train traveling over the rail switches 24 will divert from the second rail track 16 and travel along the crossover track section 12.

The crossover control system 10 also includes an interlocking control unit 26 that communicates through a communications network 28 with a train control system 30. The interlocking control unit 26 is arranged to carry out logic processing, and detection and control of the first and second point control machines 18, 22, and thereby the first and second sets of rail switches 20, 24, according to train routes determined and managed by the train control system 30. In this example, the interlocking control unit 26 is a Microlok II interlocking, although it will be understood that other types of interlocking control unit 26 are envisaged.

The interlocking control unit 26 is also arranged to transfer movement signals and information to train drivers, in this example through the rail tracks 14, 16. The movement signals and information are detected by an interface unit on a train and decoded by the interface unit, and relevant information is communicated to the train driver, for example on a driver display device or using lineside signals. In this example, the displayed information includes the maximum permitted train speed over the track section 11, the target travel speed, the current location of the train, the distance to the track section 11, and the current determined route for the train. When the train approaches the track section 11, information is displayed to the driver to indicate whether the crossover track section is set to normal or reverse, and if reverse, whether the turnout is to the left or right.

The communications network 28 may include a wireless communications network, a hard wired network such as an Ethernet network, or a combination of wired and wireless networks.

In this example, the train control system 30 is remotely located relative to mine sites, the rail network and a port facility, although it will be understood that other arrangements are envisaged.

The train control system 30 includes a train control unit 32 and an associated display 34. In this example, the train control unit 32 includes a computing device provided with appropriate software to facilitate control and management of trains on the rail network, and in particular to determine locations of trains on the network based on signals received from the rail network, and determine appropriate routes for the trains across the rail network in consideration of available track sections and track sections that are unavailable due to failures or current maintenance.

The display 34 in this example shows a representation 36 of several sections of the rail network, although in practice the display would ordinarily show the entire rail network so that a train controller at the train control system 30 is able to quickly determine the current status of the rail network, failures on the rail network and current maintenance.

The representation 36 of the sections of the rail network shows rail tracks 38 and crossover track sections 40, and in this example the train control system 30 is arranged to modify the appearance of a rail track 38 or crossover track section 40 depending on whether the rail track 38 or crossover track section 40 is operational or blocked and therefore not available for use, for example because maintenance is being carried out or scheduled to be carried out soon.

The representation 36 also includes rail switch position identifiers 42 that indicate on the representation the locations of sets of rail switches associated with crossover track sections 12. The appearance of the rail switch position identifiers 42 changes according to the status of the relevant sets of rail switches associated with the rail switch position identifiers 42, for example such that a rail switch position identifier 42 flashes when a request is received for local control of a set of rail switches, and such that the rail switch position identifier 42 is continuously illuminated when control of the set of rail switches has been transferred from the train control system 30 to maintenance personnel on site.

The crossover control system 10 also includes a first maintenance control unit (MCU) 50 associated with the first rail track 14, and a second maintenance control unit (MCU) 52 associated with the second rail track 16. Each MCU 52 is arranged to facilitate local control and monitoring of a set of rail switches, monitoring of a section of rail track 14, 16 adjacent the MCU 50, 52, and monitoring of an axle counter arranged to count train axles. The axle counter serves to determine whether and to what extent a train, or other wheeled device such as a hi-rail or track machine used in maintenance or track inspection operations, is present on the crossover track section 12.

In this example, the axle counter includes a plurality of wheel sensors 54, 56 arranged to detect presence of a wheel, the wheel sensors 54, 56 communicating wheel detection information to a crossover interface unit 58 which uses the wheel detection information to determine an axle count.

The crossover interface unit 58 also interfaces with the interlocking control unit 26 and the first and second MCUs 50, 52, and in this way facilitates communications between the first and second MCUs 50, 52 and the train control system 30.

During use, each end of the crossover track section 12 and therefore each set of rail switches 20, 22 operates either in regular mode or degraded mode.

In regular mode, the crossover end is operating normally, and routes through the sets of rail switches 20, 22 associated with the crossover end are controlled from the train control system 30 by signaling the set of rail switches directly through the interlocking control unit 26.

In degraded mode, 2 sub-modes apply such that the crossover end may be in failed mode or local control mode. In failed mode, a crossover end has failed, for example because a failure has occurred at the set of rail switches associated with the crossover end, but the crossover end is still under responsibility of the train control system 30. In local control mode, control of the crossover end has been transferred to maintenance personnel on site adjacent the crossover end and responsibility for monitoring and control of the crossover end, in particular the set of rail switches associated with the crossover end, now rests with the MCU 50, 52 on site. Local control mode may be initiated because the crossover end has moved to failed mode from regular mode, or because the crossover end has been placed in local control mode because of planned maintenance.

When a crossover end moves to local control mode, the crossover control system 10 implements a control handover process whereby responsibility for control of a crossover end, and in particular a set of rail switches associated with the crossover end, is transferred between the train control system 10 and an MCU 50, 52 disposed locally relative to the crossover end in a managed way.

As a consequence, it is possible to maintain signaled control of an operational crossover end of a crossover track section 12, even if the other crossover end is in degraded mode, and therefore possible for trains to continue to be routed through the operational crossover end according to train routes determined and controlled by the train control system 30.

Figure 2:
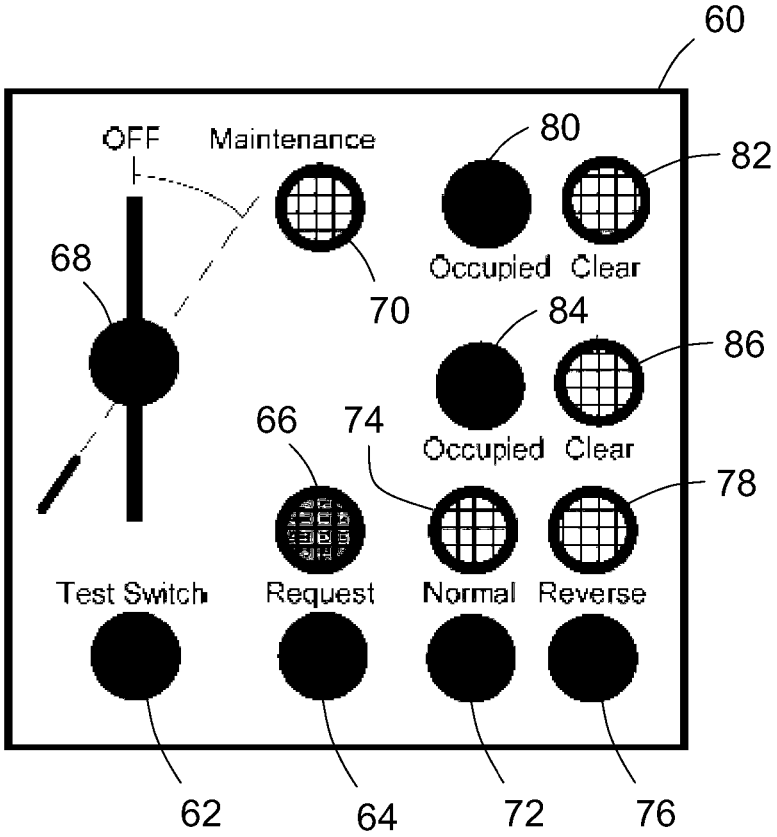
FIG. 2 is a diagrammatic representation of a control panel of a maintenance control unit of the crossover control system shown in FIG. 1.

Referring to FIG. 2, a representation of a control panel 60 of an MCU 50, 52 is shown.

The control panel 60 includes a test switch 62 usable to cause the MCU 50, 52 to carry out a self-test sequence that confirms whether the MCU 50, 52 is operating correctly.

The control panel 60 also includes a request button 64 and associated request indicator, in this example a request LED 66. The request button 64 is used to send a request signal from the MCU 50, 52 to the train control system 30 indicative that the maintenance personnel at the MCU 50, 52 wishes to take control of the crossover end associated with the MCU 50, 52 from the train control system 30. The request indicator 66 is used to communicate to the maintenance personnel the status of the control transfer request.

The control panel 60 also includes an electrically lockable maintenance switch 68 and a maintenance indicator, in this example a maintenance LED 70. The maintenance switch 68 is disposable in an OFF position and a MAINTENANCE position and in this way is used to activate and deactivate local control by the MCU 50, 52. The maintenance switch 68 is ordinarily electrically locked in the OFF position and is prevented from moving to the MAINTENANCE position by the MCU 50, 52 until an authorization signal is received from the train control system 30. The maintenance indicator 70 is used to communicate the control status to the maintenance personnel, that is, whether control of the crossover end is in progress or has been transferred to the MCU 50, 52.

The control panel 60 also includes a normal position button 72, a normal position indicator, in this example a normal position LED 74, a reverse position button 76, and a reverse position indicator, in this example a reverse position LED 78.

The normal and reverse position buttons 72, 76 are used to cause the set of rail switches associated with the MCU 50, 52 to move to the normal position or reverse position respectively for testing purposes when the MCU 50, 52 has local control of a crossover end. The normal and reverse position indicators 74, 78 serve to communicate to the maintenance personnel whether the relevant normal or reverse position of the set of rail switches associated with the MCU 50, 52 has been detected by the MCU.

The control panel 60 also includes track section occupied and clear indicators, in this example track section occupied and clear LEDs 80, 82, and crossover occupied and clear indicators, in this example crossover occupied and clear LEDs 84, 86. The track section and crossover LEDs 80, 82, 84, 86 are used to indicate to the maintenance personnel whether the rail track 14, 16 adjacent the crossover end associated with the MCU 50, 52 is occupied or clear, and whether the crossover track section 12 is occupied or clear.

During use, maintenance personnel use the MCU 50, 52 to communicate with the train control system 30, to manage transfer of crossover end control to and from the MCU 50, 52, and to monitor operation of the crossover end during maintenance.

Figure 3A:
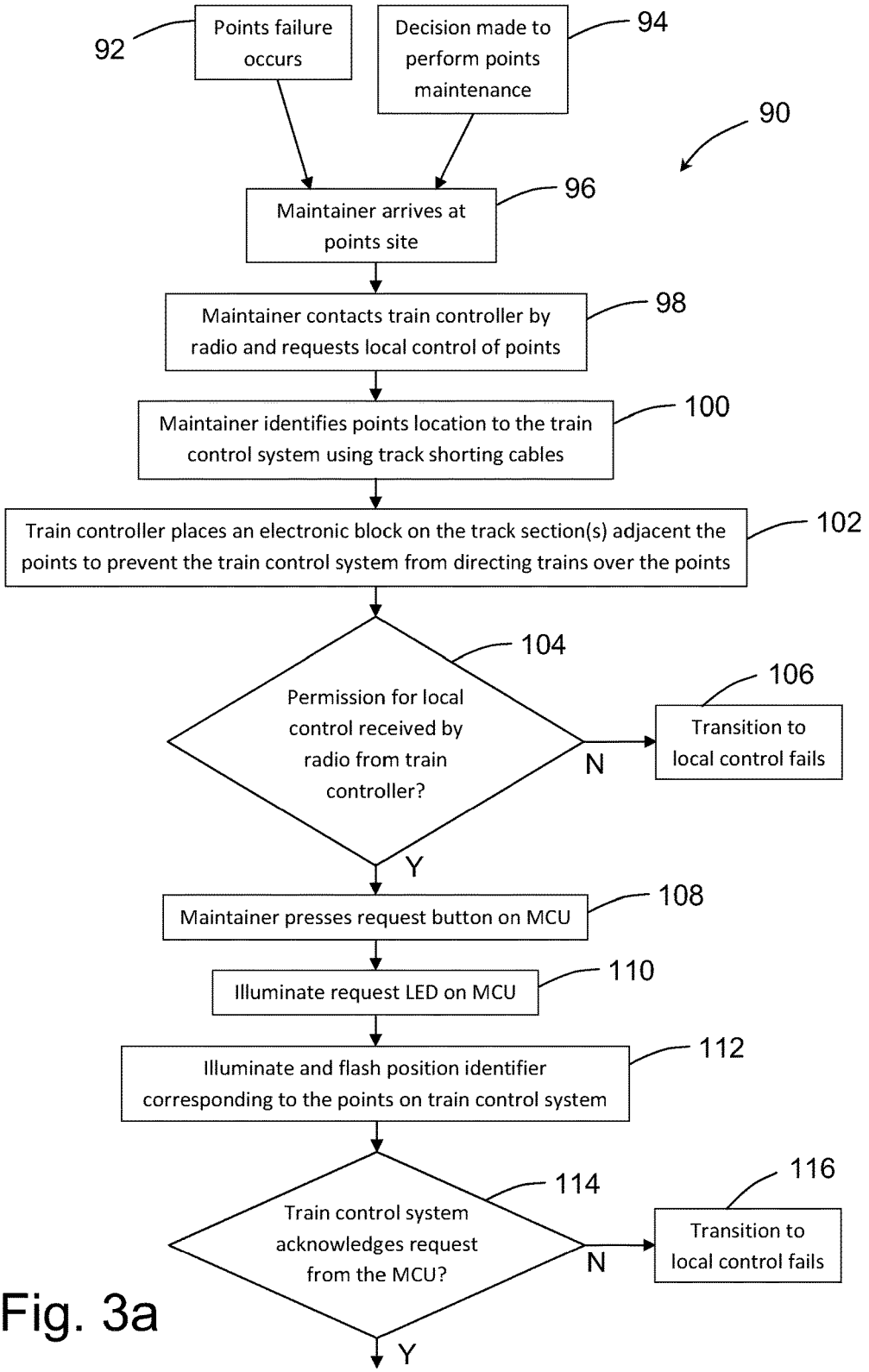
FIGS. 3*a* to 3*c* show a flow diagram illustrating steps undertaken to implement a maintenance operation in the crossover control system shown in FIG. 1.
Figure 3B:
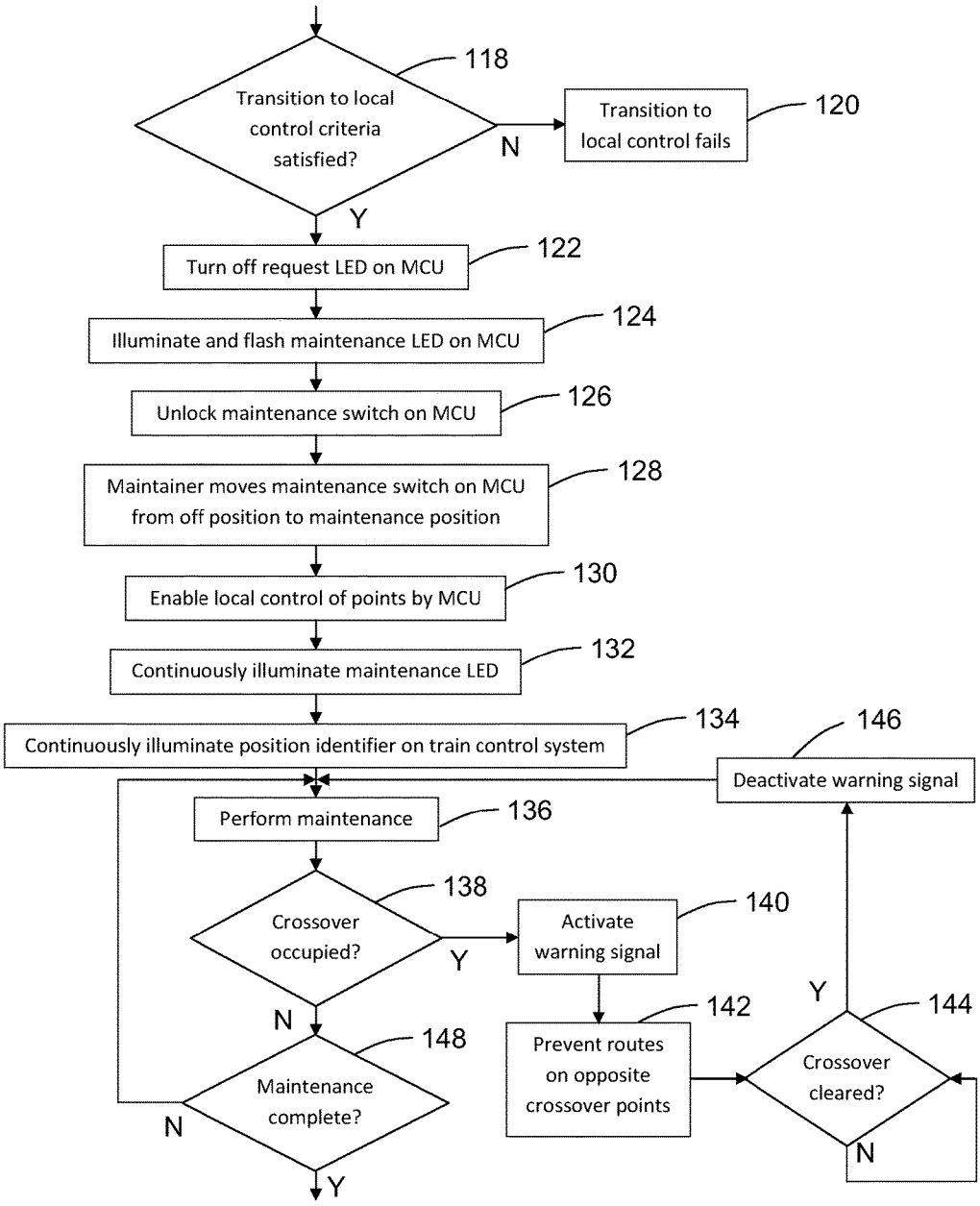
Figure 3C:
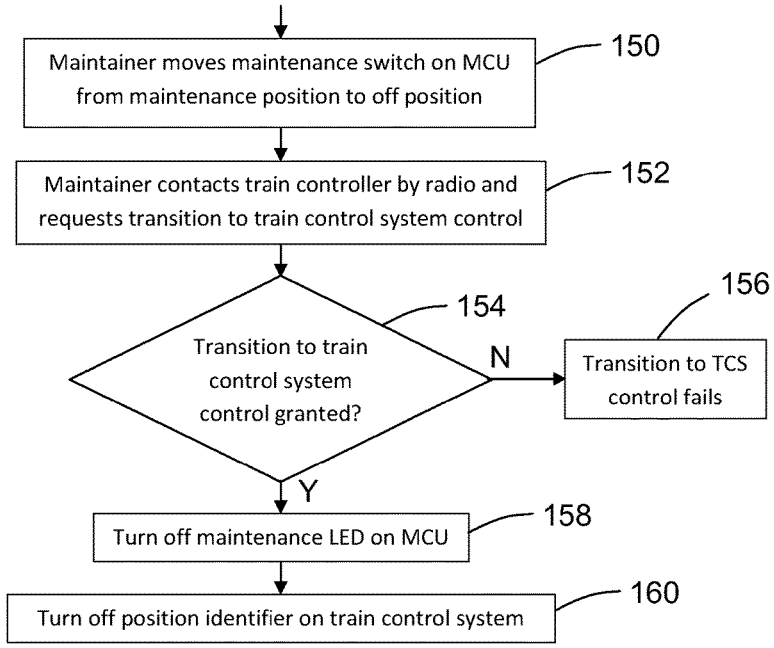

Referring to FIGS. 3*a* to 3*c*, a flow diagram 90 showing a process for transferal of control of the crossover end between the train control system 30 and an MCU 50, 52 is shown.

The control transfer process is described in this example in relation to a crossover end associated with the first set of rail switches 20 and the first MCU 50, although it will be understood that the process applies to any crossover end of the rail network that is associated with the present crossover control system.

Initially, the set of rail switches 20 are in regular mode and either the rail switches fail or a decision is made to carry out maintenance on the crossover end associated with the set of rail switches 20, as shown at steps 92 and 94.

In response to the failed mode or the maintenance decision, maintenance personnel travels to the crossover end location, as indicated at step 96, and contacts a train controller at the train control system 30 by radio to verbally request local control of the crossover end, as indicated at step 98.

The maintenance personnel also communicates his/her location to the train control system 30 by connecting a track shorting cable across the train track 14, as indicated at step 100.

In response to determining the location of the maintenance personnel, the train controller places an electronic block on the track section corresponding to the location of the maintenance personnel in order to prevent the train control system from creating train routes that pass through the crossover end, as indicated at step 102. The electronic block is maintained on the track section until control transfers back to the train control system 30.

The electronic block may be placed on the track section in any suitable way, and in this example this is achieved by the train controller selecting the or each relevant track section(s) 38 on the track representation 36 shown on the display 34 of the train control system 30.

If verbal permission for transfer to local control is not given by the train controller by radio, the transition to local control fails, as indicated at steps 104 and 106. If verbal permission is given, then the maintenance personnel presses the request button 64 on the MCU control panel 60, as indicated at step 108. This causes the request LED 66 to illuminate on the MCU control panel 60, and the MCU to communicate a local control request signal to the train control system 30 that causes the train control system to illuminate and flash a position identifier 42 corresponding to the crossover end on the display 34, as indicated at steps 110 and 112. In this way, the train controller is provided with confirmation as to the location of the maintenance personnel on the rail network.

In response to the received local control transfer request signal indicated by the flashing position identifier 42, the train controller can choose to cancel the request, which causes the transition to local control to fail, as indicated at steps 114 and 116, or to acknowledge the request. If the request is acknowledged by the train controller, the train control system carries out a safety check to determine whether the transfer request can be authorized by the train control system based on local control transfer criteria, as indicated at steps 118 and 120. In this example the local control transfer criteria include whether:

i) all train routes are normal for both ends of the crossover;
ii) the crossover section is unoccupied according to the axle counter;
iii) the set of rail switches at the crossover end opposite to the crossover end under request are normal or in local control mode;
iv) the track section associated with the crossover end under request has an electronic block placed on it at the train control system; and
v) the maintenance switch at the MCU associated with the crossover end under request is in the OFF position.

If the local control transfer criteria are not satisfied, the request to transfer to local control will fail.

If the local control transfer criteria are satisfied, an acknowledge signal is sent from the train control system 30 to the requesting MCU 50 which causes the request LED 66 on the control panel 60 to extinguish, and the maintenance LED on the control panel 60 to flash, as indicated at steps 122 and 124.

The acknowledge signal received from the train control system 30 also causes the maintenance switch 68 on the control panel 60 to electrically unlock, which allows the maintenance personnel to move the maintenance switch 66 from the OFF position to the MAINTENANCE position, as indicated at steps 126 and 128. It will be understood that it is not possible for the maintenance personnel to move the maintenance switch 66 to the MAINTENANCE position until the acknowledgement signal is received from the train control system 30.

Movement of the maintenance switch 66 to the MAINTENANCE position causes activation of local control by the MCU 50, which enables the maintenance personnel to monitor operation of the crossover end during maintenance. Local control transfer to the MCU 50, 52 is indicated at the MCU 50 by continuously illuminating the maintenance LED 70 and at the train control system 30 by continuously illuminating the previously flashing position identifier 42 on the display 34, as indicated at steps 130-134.

Since the train control system 30 has placed a block on trains passing through the crossover end, and control over the crossover end is now with the MCU 50, the maintenance personnel is able to safely carry out maintenance on the crossover end, as indicated at step 136. As part of the maintenance process, the maintenance personnel is able to directly control the position of the set of rail switches 20 by pressing the normal and reverse position buttons 72, 76 on the control panel, observing whether the rail switches have moved accordingly and observing that the MCU 50 has detected the change of position by viewing the normal and reverse position LEDs 74, 78. The maintenance personnel is also able to determine from the occupied and clear LEDs 80, 82, 84, 86 whether the rail track 14, 16 adjacent the crossover end and the crossover track section 12 are occupied.

It will be understood that while the crossover end associated with the first set of rail switches 20 is in local control mode, the opposite crossover end associated with the second set of rail switches 24 is still able to remain in regular mode since the train control system 30 has placed a block on trains passing through the first set of rail switches 20; the train control system 30 has confirmed with the MCU 50 that the first set of rail switches 20 are under local control through a rigorous electronic handover process; and the train control system, in response to acknowledging the train control request from the MCU 50, ensures that second set of rail switches 24 at the opposite crossover end are fixed in the normal position.

As indicated at steps 138-146, after control has been transferred to the MCU 50, the MCU 50, through the crossover interface unit 58, continuously monitors the crossover track section 12 to make sure that no obstruction is present on the crossover track section 12 that may cause an accident should a train pass through the second set of rail switches at the opposite crossover end. Typically, such obstructions occur because of maintenance equipment that may be used by the maintenance personnel, such as hi-rail or track machines. If such an obstruction is detected by the axle counter, an audible and visible warning signal is generated at the MCU 50. In response to the detected obstruction, a warning signal is sent from the MCU 50 to the interlocking control unit 26 through the crossover interface unit 58 and to the train control unit 30, which causes the interlocking control unit 26 to prevent train routes from passing through the opposite crossover end.

For safety, in this example the opposite crossover end can only return to regular mode if a clear signal is received at the interlocking control unit 26.

At the train control unit 30, when the axle counter determines that the crossover track section 12 is occupied, an occupied indicator 59 is displayed on the display 34 adjacent the relevant crossover track section 12. In order to determine that the crossover track section 12 is clear, the train controller may check whether track sections adjacent the crossover track section 12 are clear, and/or speak to the maintenance personnel on site. The clear signal sent to the MCU 50 may be initiated by selecting the occupied indicator 59 on the display 34.

These steps are shown at 138-146 of the flow diagram.

After completion of maintenance 148, the maintenance personnel moves the maintenance switch 68 from the MAINTENANCE position to the OFF position, as indicated at step 150, which de-activates local control. This causes the maintenance switch 68 to automatically electrically lock in the OFF position. The maintenance personnel also calls the train controller at the train control system 30 by radio and verbally requests transition of control from the MCU 50 back to the train control system 30, as indicated at step 152.

In response to moving the maintenance switch 68 to the OFF position, the MCU 50 turns off the maintenance LED 70, the MCU 50 sends a communication to the train control system 30 indicative that control is to pass back to the train control system 30, and the train control system 30 turns off the position identifier 42 corresponding to the crossover end on the display 34, as indicated at steps 158 and 160. The train controller is then able to remove the electronic block placed on the track section adjacent the crossover end associated with the first set of rail switches 20.

In this way, the crossover end moves from local control mode back to regular mode or failed mode, depending on whether the crossover end is determined to be operational or not.

However, if a route has already been set whereby a train is to pass over the set of rail switches at the opposite end of the crossover, then the crossover end is maintained in degraded mode until the route over the opposite end of the crossover is normalized.

Figure 4:
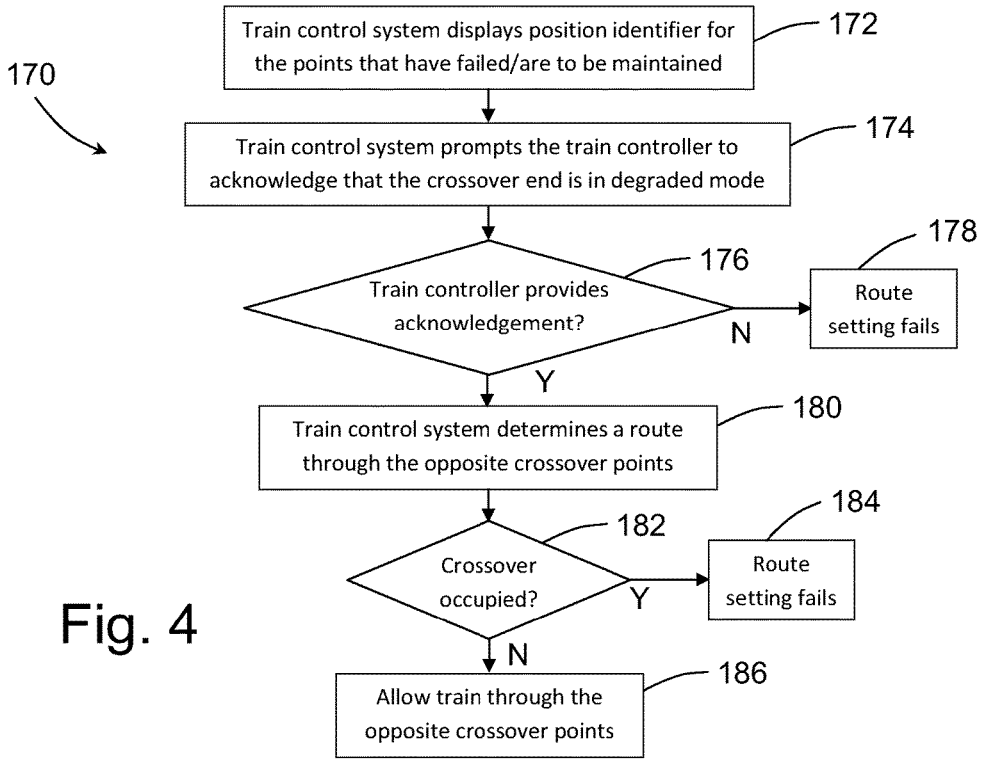
FIG. 4 is a flow diagram illustrating steps undertaken to authorize a route through an operational set of rail switches of a crossover track section when a set of rail switches of the crossover track section has failed.

Referring to FIG. 4, a flow diagram 170 showing steps 172-180 of a process for setting a train route with a crossover end in degraded mode is shown.

The degraded mode train route setting process is used when one end of a crossover track section is in degraded mode (failed mode or local control mode) and the opposite crossover end is in regular mode.

The route setting process is described in this example in relation to a crossover end associated with the first set of rail switches 20 and the first MCU 50, although it will be understood that the process applies to any crossover end of the rail network that is associated with the present crossover control system 10.

With the crossover end in degraded mode (local control mode) and the opposite crossover end in regular mode, the display 34 at the train control system 30 displays a continuously illuminated rail switch position identifier 42.

With the crossover end in degraded mode (failed mode) and the opposite crossover end in regular mode, the display 34 at the train control system 30 displays a flashing rail switch position identifier 42.

Prior to setting a route over the opposite crossover end, the train control system 30 prompts the train controller to acknowledge that the crossover end is in degraded mode, as indicated at step 174. When the train controller has provided acknowledgement, the train control system 30 determines a route through the opposite crossover end. The train route is allowed through the opposite crossover end unless the crossover track section 12 is determined to be occupied by the axle counter, otherwise the route setting fails, as indicated at steps 176 to 186.

It will be understood that the present system enables a crossover end of a crossover track section to remain open even though the opposite crossover end is inoperative, and as a consequence throughput of trains is increased. In other words, route setting over a crossover end is possible independent of the position of the set of rail switches on the other crossover end, and the impact on train operations during periods of maintenance or failure of point machines within a rail crossover is reduced by continuing to provide route setting functionality on the track containing the unaffected sets of rail switches. This is particularly significant for a mining operation wherein a bulk commodity is transported from mine sites to port facilities, because significant reductions in throughput of bulk commodity to the port facilities can be avoided.

It will be appreciated that the present crossover control system improves maintenance personnel safety by ensuring that an electronic block is in place prior to allowing local control mode and thereby transfer of rail switches control to the MCU.

It will also be appreciated that the present crossover control system improves maintenance personnel safety because the position of the maintenance personnel is determined electronically in response to activation of the request button 64 on the MCU.

It will also be appreciated that the present crossover control system improves train driver safety because the reliance on manually issued movement authorities during periods of maintenance or failure of one end of the crossover is removed.

Modifications and variations as would be apparent to a skilled addressee are deemed to be within the scope of the present invention.

The claims defining the invention are as follows:

1. A rail crossover control system for a rail track section of a rail network, the rail track section having first and second rail tracks, a crossover track section extending between the first and second rail tracks, at least one first set of rail switches arranged to controllably determine whether a train continues on the first track or is diverted from the first track onto the crossover track section, and at least one second set of rail switches arranged to controllably determine whether a train continues on the second track or is diverted from the second track onto the crossover track section, the system comprising:

at least one interlocking control unit in cooperation with a train control system so as to control the first and second sets of rail switches according to determined train routes managed by the train control system;

a maintenance control unit (MCU) disposed adjacent the rail track section and arranged to facilitate local control and monitoring of at least one set of rail switches when control of the at least one set of rail switches has been handed over from the train control system to the MCU; and an obstruction detector comprising at least two wheel sensors arranged to sense presence of a wheel on the crossover track section and generate an obstruction signal when each of the following is satisfied:

the at least two wheel sensors sense the presence of a wheel;

the at least one first set of rail switches is under the control of the MCU and inoperative; and the at least one second set of rail switches is operative;

the interlocking control unit arranged to prevent trains from traveling over the at least one second set of operative rail switches when the obstruction signal is generated.

2. A rail crossover control system as claimed in claim 1, wherein at least one wheel sensor is disposed adjacent a first end of the crossover track section, and at least one wheel sensor is disposed adjacent a second opposite end of the crossover track section.

3. A rail crossover control system as claimed in claim 2, wherein the obstruction detector includes an axle counter, the axle counter including at least two wheel sensors.

4. A rail crossover control system as claimed in claim 1, wherein the rail crossover control system is arranged to manage handover of control of the at least one set of rail switches of the rail track section between the train control system and the MCU.

5. A rail crossover control system as claimed in claim 4, wherein handover of control of the at least one set of rail switches of the rail track section between the train control system and the MCU is at least partly managed by the MCU.

6. A rail crossover control system as claimed in claim 5, wherein the MCU is arranged to facilitate sending of a request communication from the MCU to the train control system, the request communication indicative that an operator at the MCU wishes to transfer control of the at least one set of rail switches to the MCU.

7. A rail crossover control system as claimed in claim 6, wherein the train control system is arranged to receive the request communication and in response to communicate the location of the at least one set of rail switches associated with the request to a train controller.

8. A rail crossover control system as claimed in claim 7, wherein the train control system is arranged to facilitate selection of a section of rail track or crossover track section, and to add an electronic block to the selected section of rail track or crossover track section, the electronic block serving to prevent the train control system from setting train routes that pass through the selected section of rail track or crossover track section.

9. A rail crossover control system as claimed in claim 8, wherein the train control system is arranged to send an acknowledgement communication only if at least one local control criterion is satisfied, and wherein the at least one local control criterion comprises:

i) all train routes are normal for both ends of the crossover track section;

ii) the crossover track section is unoccupied;

iii) the set of rail switches at the crossover end opposite to the crossover end under request are operational or under control of the MCU;

iv) the rail track associated with the crossover end under request has an electronic block placed on it at the train control system; and v) a maintenance switch is in the OFF position.

10. A rail crossover control system as claimed in claim 1, wherein the MCU comprises at least one visual indicator arranged to communicate to an operator the status of handover of control of the at least one set of rail switches to the MCU, whether the crossover track section or rail tracks associated with the rail track section are occupied or clear, and/or whether the at least one set of rail switches are operating correctly when controlled by the MCU.

11. A rail crossover control system as claimed in claim 1, wherein the rail crossover control system is arranged to generate an audible and/or visible alarm at the rail track section when an obstruction is detected on the crossover track section.

12. A method of controlling a rail crossover of a rail track section of a rail network, the rail track section having first and second rail tracks, a crossover track section extending between the first and second rail tracks, at least one first set of rail switches arranged to controllably determine whether a train continues on the first track or is diverted from the first track onto the crossover track section, and at least one second set of rail switches arranged to controllably determine whether a train continues on the second track or is diverted from the second track onto the crossover track section, the method comprising:

using at least one interlocking control unit in cooperation with a train control system to detect and control the first and second sets of rail switches according to determined train routes managed by the train control system when the first and second sets of rail switches are operative;

disposing a maintenance control unit (MCU) adjacent the rail track section, the MCU arranged to facilitate local control and monitoring of at least one set of rail switches when control of the at least one set of rail switches has been handed over from the train control system to the MCU;

sensing presence of a wheel on the crossover track section using at least two wheel sensors when each of the following is satisfied:

the at least one first set of rail switches is inoperative and under the control of the MCU; and the at least one second set of rail switches is operative; and preventing trains from traveling over the at least one second set of operative rail switches when an obstruction is detected.

13. A method as claimed in claim 12, comprising sensing presence of a wheel on a rail track adjacent a first end of the crossover track section, and sensing presence of a wheel on a rail track adjacent a second opposite end of the crossover track section.

14. A method as claimed in claim 13, comprising using the sensed wheels to calculate an axle count.

15. A method as claimed in claim 12, comprising managing train routes over the rail network using the train control system.

16. A method as claimed in claim 15, comprising using the MCU to manage handover of control of the at least one set of rail switches of the rail track section between the train control system and the MCU.

17. A method as claimed in claim 16, comprising sending a request communication from the MCU to the train control system, the request communication indicative that an operator at the MCU wishes to transfer control of the at least one set of rail switches to the MCU.

18. A method as claimed in claim 17, comprising receiving the request communication at the train control system and in response communicating the location of the at least one set of rail switches associated with the request to a train controller.

19. A method as claimed in claim 18, comprising sending an acknowledgement communication from the train control system to the MCU, the acknowledgement communication indicative that a train controller approves the request to transfer control of the at least one set of rail switches to the MCU.

20. A method as claimed in claim 18, comprising facilitating selection of a section of rail track or crossover track section at the train control system, and adding an electronic block to the selected section of rail track or crossover track section, the electronic block serving to prevent the train control system from setting train routes that pass through the selected section of rail track or crossover track section.

* * * * *